United States Patent [19]

Pelletier

[11] 4,083,126

[45] Apr. 11, 1978

[54] STUDDED BOOTS FOR FIREFIGHTERS

[75] Inventor: Henri Pelletier, Waltham, Mass.

[73] Assignee: The Raymond Lee Organization, Inc., New York, N.Y. ; a part interest

[21] Appl. No.: 746,072

[22] Filed: Nov. 30, 1976

[51] Int. Cl.[2] ..... A43C 15/00; B60B 9/00

[52] U.S. Cl. ..... 36/67 D; 152/10

[58] Field of Search ..... 36/67 D, 59 R, 7.3, 36/4, 113; 152/10, 11, 13 R; 81/71, 53, 2, 3; 29/280

[56] References Cited

U.S. PATENT DOCUMENTS

| | | | |
|---|---|---|---|
| 2,627,888 | 2/1953 | Bull | 152/210 |
| 2,817,987 | 12/1957 | Bosse | 81/71 X |
| 3,512,275 | 5/1970 | Leavitt | 36/67 D |
| 3,846,921 | 11/1974 | Kobayashi | 36/59 R |
| 3,859,739 | 1/1975 | Dassler | 36/67 D |

FOREIGN PATENT DOCUMENTS

| | | | |
|---|---|---|---|
| 2,259,451 | 6/1974 | Germany | 36/59 R |

*Primary Examiner*—Patrick D. Lawson
*Attorney, Agent, or Firm*—Howard I. Podell

[57] ABSTRACT

A boot with studs built into the sole and heel sections to afford the wearer maximum traction in snow, sleet and ice thereby preventing slippage and possible injury to the wearer during execution of required duties.

1 Claim, 6 Drawing Figures

STUDDED BOOTS FOR FIREFIGHTERS

SUMMARY OF THE INVENTION

My invention is a boot with studs built into the sole and heel sections to afford the wearer maximum traction in snow, sleet and ice thereby preventing slippage and possible injury to the wearer during execution of required duties.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
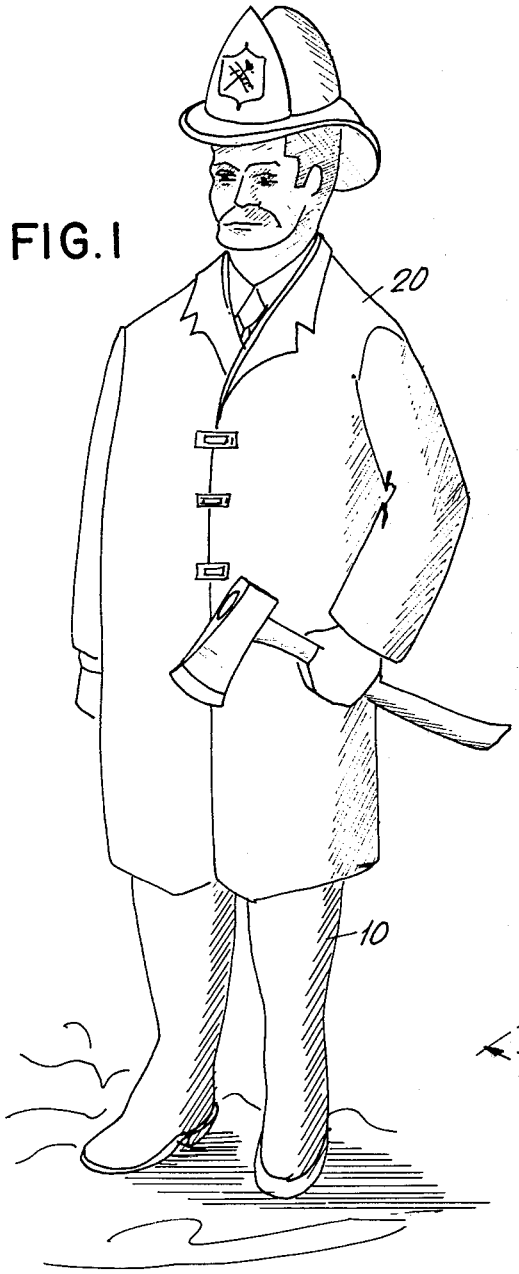
FIG. 1 is a perspective view of the invention in use.
Figure 6:
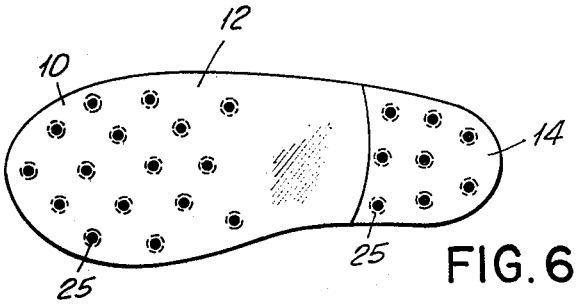
FIG. 6 is a bottom view of the invention.
Figure 2:
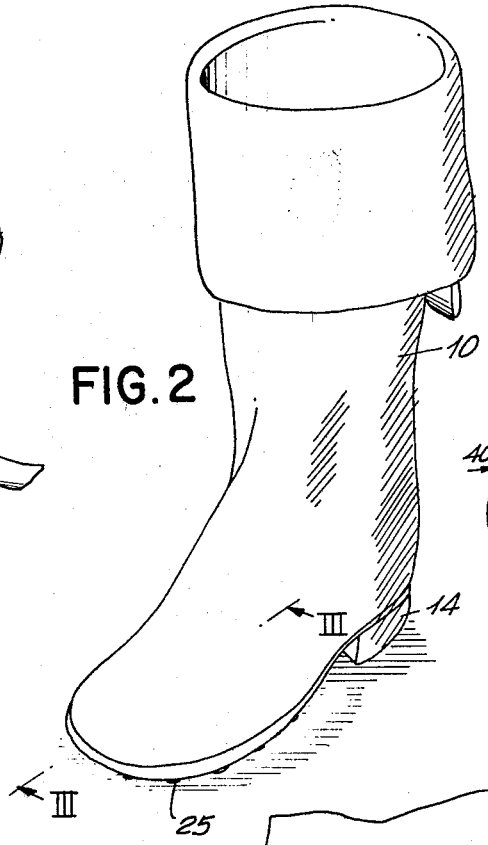
FIG. 2 is a perspective view of the invention.

Turning now descriptively to the drawings, in which similar reference characters denote similar elements throughout the several views, FIGS. 1–3 and 6 illustrate the boot 10 with studs 25 built into the sole section 12 and heel section 14 to provide the wearer 20 maximum traction underfoot to prevent accidental slippage in snow, sleet and ice surface conditions.

Figure 3:
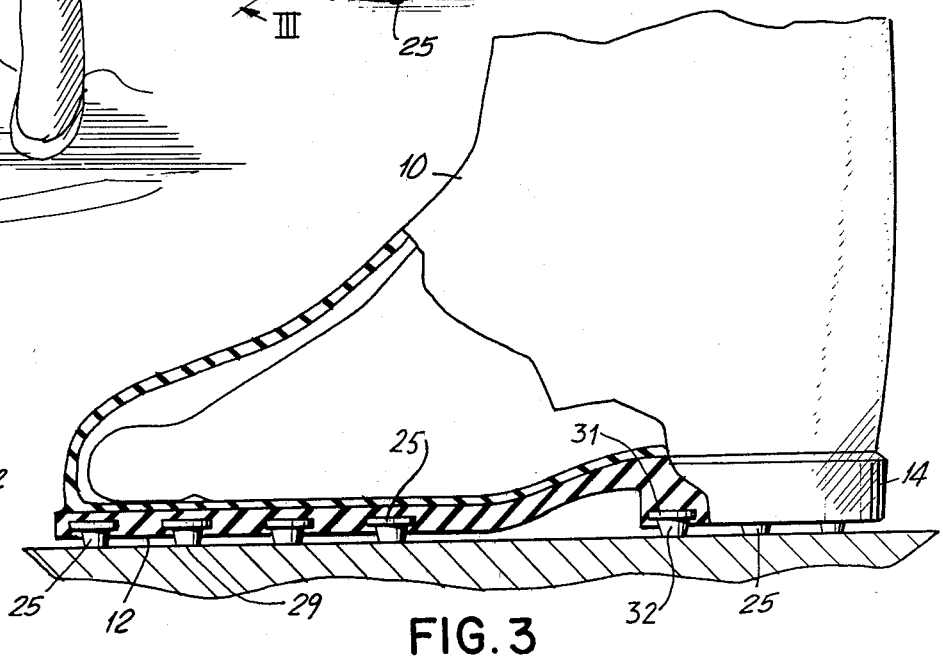
FIG. 3 is a side sectional view of the invention, taken along line III—III of FIG. 2.

As shown in FIG. 3, the studs 25 protrude from the bottom surfaces of the sole 12 and heel 14 of boot 10. The head portion 31 of the stud 25 is disc-shaped and the shank portion 32 is of truncated conical configuration so that the lateral projecting head portion 31 of each stud 25 will be retained in an undercut groove 47 in the sole and heel with the shank portion 32 tapered towards the external face 29 of the studs 25.

The studs 25 may be formed of hard rubber or plastic material and form an integral part of the construction of the sole and heel sections of the boot 10 in the preferred embodiment of the boot 10.

Figure 4:
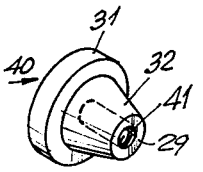
FIG. 4 is a perspective view of a stud of the boot.
Figure 5:
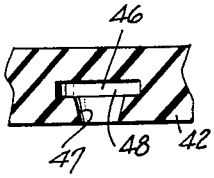
FIG. 5 is a detail sectional view of the sole of the boot.

Alternately, as shown in FIGS. 4–5, the stud 40 may be replaceable in the sole 42 of a boot, with stud 40 of similar shape and material as stud 25 but formed with a blind threaded axial hole 41 open to the external face 29 of the stud so that a threaded tool may be inserted into hole 41 to insert the stud into a shaped hole 48 in a sole 42 or heel of a boot. Hole 48 is formed with an undercut annular groove 46 of a size to engage head 31 of stud 40, and with a tapered wall 47 of a size to snugly engage the shank section 32 of stud 40 in detachable engagement.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A flexible boot, the sole and heel portion of which are fitted with projecting studs, in which the studs are detachably engaged in the boot, and in which an axial blind threaded hole is formed in each stud, with said hole open to the exterior face of the stud, said hole serving as means to engage a threaded tool for removal of a stud from the boot.

* * * * *